US006105821A

United States Patent [19]

Christine et al.

[11] Patent Number: 6,105,821

[45] Date of Patent: Aug. 22, 2000

[54] DISPENSING CONTAINER FOR HIGHLY VISCOUS LIQUIDS

[76] Inventors: William C. Christine, 876 Bangor Rd., Nazareth, Pa. 18064; George Alan Crockett, 18 Roman Way, Dunblane, Perthshire, United Kingdom, FK15 9DQ

[21] Appl. No.: 09/188,425

[22] Filed: Nov. 9, 1998

[30] Foreign Application Priority Data

Nov. 10, 1997 [GB] United Kingdom ..... 9723736

[51] Int. Cl.[7] ..... B65D 35/56

[52] U.S. Cl. ..... 222/105; 383/104

[58] Field of Search ..... 222/95, 105, 464.2; 383/104, 119, 107

[56] References Cited

U.S. PATENT DOCUMENTS

| | | | |
|---|---|---|---|
| 5,452,844 | 9/1995 | Bochet et al. | 383/104 |
| 5,671,871 | 9/1997 | Hoare | 222/105 |
| 5,944,251 | 8/1999 | LaFleur | 383/104 |

FOREIGN PATENT DOCUMENTS

| | | | |
|---|---|---|---|
| 756093 | 8/1956 | United Kingdom | 222/464.2 |
| 2214486A | 6/1989 | United Kingdom | B65D 33/36 |
| 2314069A | 12/1997 | United Kingdom | B65D 75/58 |
| WO97/10152A1 | 10/1996 | WIPO | B65D 75/58 |

*Primary Examiner*—Philippe Derakshani
*Attorney, Agent, or Firm*—Cort Flint; William D. Lee, Jr.

[57] ABSTRACT

An ink box for a stencil duplicator comprises a flexible pouch within a rectangular parallelepiped-shaped carton and having a discharge fitment penetrating the carton and the container. The panel in which the discharge fitting is formed is substantially rectangular and is held substantially flat by two bracing seal lines which are parallel to one another and extend transversely to a longitudinal seal line in which the fitting is sealed. The opposite end of the bag has a gusset defined between short inclined seal lines. A flow inducer fitment within the pouch defines continuous flow paths from the tips of spreader arms of the flow inducer fitment to the discharge fitting.

19 Claims, 9 Drawing Sheets

Fig.9.

PPP YIELD VALUES USING LIGHT PLATE PLASTOMETER
(WT.28.6 grms) (Time 15 mins) (Vol.1ml)

| Spread (CMS) | YV | Spread (CMS) | YV | Spread (CMS) | YV |
|---|---|---|---|---|---|
| 1 | 100,700 | 2.35 | 825 | 3.7 | 211 |
| 1.05 | 9240 | 2.4 | 775 | 3.75 | 203 |
| 1.1 | 8040 | 2.45 | 728 | 3.8 | 194 |
| 1.15 | 7040 | 2.5 | 686 | 3.85 | 188 |
| 1.2 | 6190 | 2.55 | 645 | 3.9 | 180 |
| 1.25 | 5500 | 2.6 | 610 | 3.95 | 174 |
| 1.3 | 4880 | 2.65 | 575 | 4 | 167 |
| 1.35 | 4350 | 2.7 | 545 | 4.1 | 160 |
| 1.4 | 3920 | 2.75 | 515 | 4.2 | 145 |
| 1.45 | 3520 | 2.8 | 490 | 4.3 | 134 |
| 1.5 | 3180 | 2.85 | 462 | 4.4 | 125 |
| 1.55 | 2900 | 2.9 | 439 | 4.5 | 117 |
| 1.6 | 2610 | 2.95 | 416 | 4.6 | 110 |
| 1.65 | 2390 | 3 | 396 | 4.7 | 103 |
| 1.7 | 2180 | 3.05 | 376 | 4.8 | 97 |
| 1.75 | 2000 | 3.1 | 359 | 4.9 | 91 |
| 1.8 | 1840 | 3.15 | 342 | 5 | 86 |
| 1.85 | 1690 | 3.2 | 326 | 5.1 | 81 |
| 1.9 | 1565 | 3.25 | 323 | 5.2 | 76 |
| 1.95 | 1450 | 3.3 | 298 | 5.3 | 72 |
| 2 | 1340 | 3.35 | 286 | 5.4 | 68 |
| 2.05 | 1240 | 3.4 | 272 | 5.5 | 65 |
| 2.1 | 1150 | 3.45 | 260 | 5.6 | 61 |
| 2.15 | 1080 | 3.5 | 250 | 5.7 | 58 |
| 2.2 | 1001 | 3.55 | 239 | 5.8 | 55 |
| 2.25 | 940 | 3.6 | 230 | 5.9 | 52 |
| 2.3 | 882 | 3.65 | 221 | 6 | 50 |

FOR USE WITH ALL PLATES BETWEEN 28-29 GMS
PLATES OUTSIDE THESE LIMITS MUST NOT BE USED

DISPENSING CONTAINER FOR HIGHLY VISCOUS LIQUIDS

FIELD OF THE INVENTION

The present invention relates to a container for printing ink or other liquid of a relatively viscous nature, and in particular to a flexible pouch for containing a reservoir of ink which can be drawn from the pouch.

1. Prior Art

Ink container pouches have in the past been proposed, usually enclosed within a cardboard rectangular parallelepiped-shaped box, for being positioned in a suitable recess of a printing machine such as a stencil duplicator equipped with a vacuum pump which draws the ink from the container on demand.

In the past, complete emptying of the package has not been possible because of a tendency of the bag to collapse on to itself and to form remote from this ink outlet sealed pockets in which ink remains and from which the ink cannot then be drawn. Atmospheric pressure tending to press the contacting opposite sides of the pouch more firmly into contact with one another achieves this undesired sealing action. Well in excess of 5% of the contents of the pouch remain in the discarded pouch when the vacuum pump is unable to withdraw any more ink. Whereas such a pouch can readily allow withdrawal of virtually all of the contents of a liquid (such as wine) of relatively low viscosity in the more commonly known (wine bag-in-box) system, the problem of inaccessible residue in the pouch is particularly acute in the case of inks having a parallel plate plastometer (PPP) measurement in the range of 1.4 cm to 3.5 cm. This corresponds to "spread-o-meter" readings of 26 to 56, as determined under Section 4-1-2 of Japanese standard JIS 5701-1980 "Testing methods for lithographic and letterpress inks".

2. Object Of The Invention

It is an object of the present invention to provide a design of container which helps to overcome the problem of self-sealing of the known ink pouch to define pockets of inaccessible residue. Preferably, means may be associated with the pouch to assist the avoidance of these inaccessible residue pockets.

SUMMARY OF THE INVENTION

Accordingly, a first aspect of the present invention provides a container for a liquid to be dispensed, comprising a flexible pouch having a discharge fitting secured to the pouch to communicate between the interior and the exterior of the pouch; and a flow-inducing fitment is disposed within the pouch to define continuous flow passages for liquid contents of the container from the tips of spreader arms of said flow inducer fitment to said discharge fitting outside the pouch; wherein the pouch is formed of flexible sheet material having a stiffened substantially flat face in which said discharge fitting is secured, and wherein the projection of the interior of the pouch on the plane of said substantially flat face is within the perimeter of said substantially flat face.

A second aspect of the present invention provides a method of forming a container of the first aspect comprising arranging a film web with marginal portions adjacent one another to define first and second web panels extending from said marginal portions towards a central folded zone, and arranging said folded central film region to have a portion folded inwardly between said first and second film panels;

forming transverse seals across said folded film web to define discrete pouch portions with a gusset remote from said adjacent marginal portions of the film web;

sealing said marginal portions together along a longitudinal seal line with a said discharge fitting between the marginal film portions at said seal to seal the discharge fitting to the pouch; and forming transverse seals intersecting said longitudinal seal line to rigidify the face of the pouch in which said discharge fitment is located.

A third aspect of the invention provides a method of dispensing a viscous product having a parallel plate plastometer measurement of from 1.4 to 3.5 cm, comprising introducing the viscous product into a container according to the first aspect, connecting the discharge fitting to the inlet side of a suction pump, and extracting the viscous product from the interior of the pouch, as required, by way of the discharge fitting and the suction pump.

BRIEF DESCRIPTION OF THE DRAWINGS

In order that the present invention may more readily be understood the following description is given, merely by way of example, with reference to the accompanying drawings, in which:

FIG. 9 is a calibration table showing the yield value in dynes/cm$^2$ elated to the mean diameter of an ink blob spread after 15 minutes have elapsed, between standard test plates, as described herein.

DETAILED DESCRIPTION OF THE PREFERRED EMBODIMENT

Figure 1:
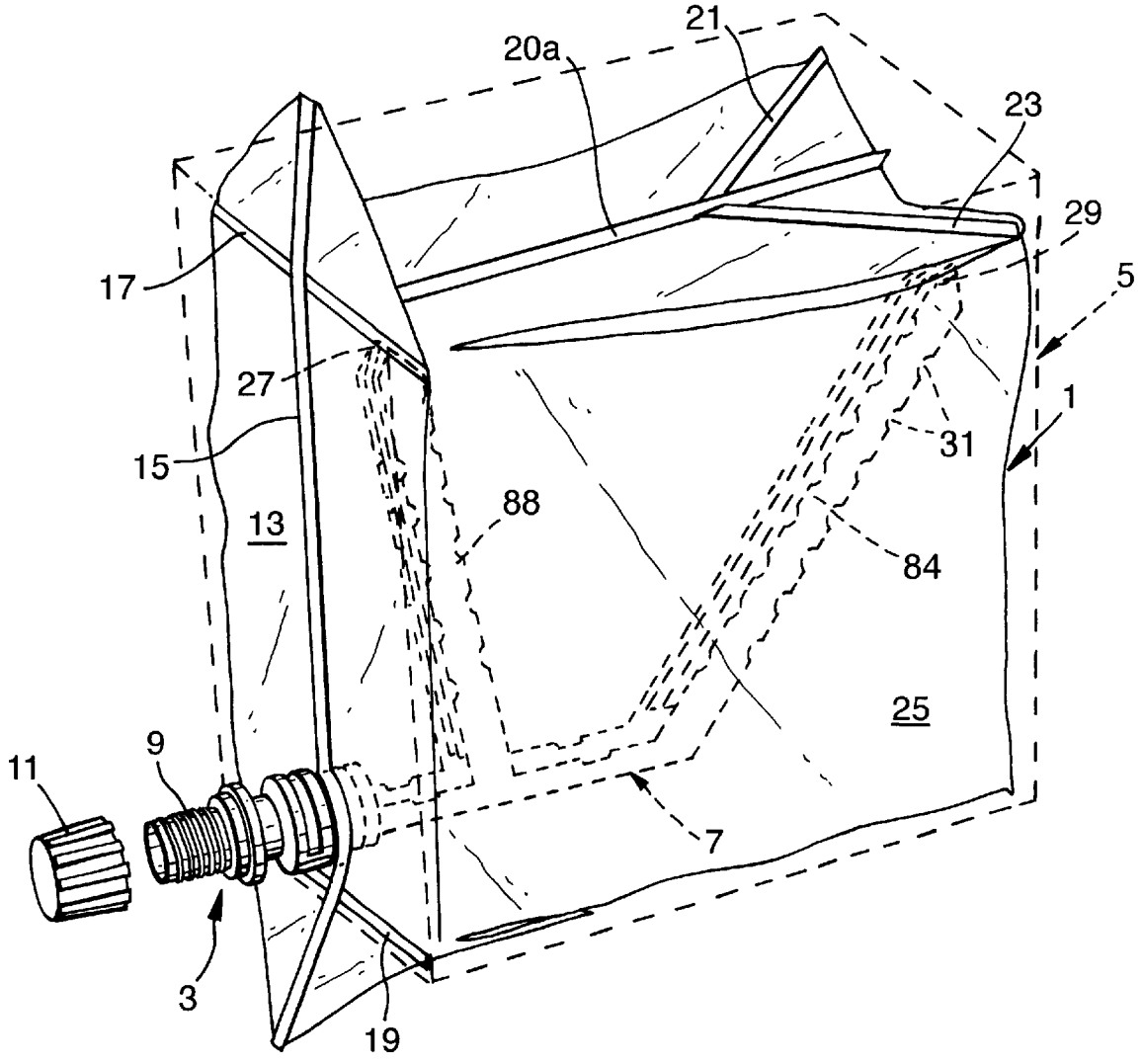
FIG. 1 is a perspective view of an expanded (empty or filled) pouch of a container in accordance with the present invention, and showing in broken lines the outline of a rectangular parallelepiped-shaped "secondary packaging" box within which the pouch will in use be positioned.

Referring now to the drawings, FIG. 1 shows a perspective view of a completed pouch 1 of flexible film material fitted with a discharge fitting 3 of moulded thermoplastic material and enclosed within a rectangular parallelepiped-shaped cardboard box or carton 5 which forms a secondary packaging around the flexible pouch 1. Within the pouch, the discharge fitting 3 is extended by a moulded thermoplastic flow inducer fitment 7 which provides continuous flow paths from various locations along its length towards the end of the discharge fitting 3 which traverses the secondary packaging carton 5 to provide an externally threaded outlet portion 9 able to receive a closure cap 11 but eventually also able to receive a suitable female fitting of a stencil duplicator from which ink within the pouch 5 is withdrawn under the action of a suction pump (not shown).

The present invention aims to provide a construction of the pouch 1 which allows it to collapse progressively in a controlled manner and in such a way that the contents of the pouch do not become trapped in inaccessible pockets sealed by virtue of contact of opposing wall faces of the pouch. To this end the pouch has a first end panel 13 which is braced by a longitudinal seal 15 intersected near its ends by respective upper and lower transverse seals 17, 19 so that, in practice, the panel 13 will tend to remain flat and in contact with the adjacent wall of the carton 5.

At the opposite end of the pouch (the right hand side in FIG. 1) are gussets defined between two inclined seals 21, 23 which enable the right hand ends of the front panel 25 and the opposing rear panel (not visible in FIG. 1) to fold together towards one another at the end of the pouch (the right hand end) remote from the discharge fitting 3. As a result, any tendency for the front and rear walls of the pouch to collapse towards one another in their central regions is delayed until the gusset structure between inclined seams 21, 23 at the top and the corresponding seams (not visible) at the bottom of the pouch 1 have undergone substantial collapse. The gusset seals 21 and 23 intersect each other and an end seal 20a at a single point.

Although it may not be entirely clear from FIG. 1, the projection of the part of the pouch to the right of the end panel 13 onto the plane of the end panel 13 (in which the discharge fitting 3 is attached) all lies within the perimeter of the end panel 13. In other words, the pouch behind the end panel 13 is substantially of rectangular parallelepiped shape and this, together with the gusseted configuration of the back end of the pouch (remote from the front panel 13), helps to provide the preferred collapsing mode.

The result of this preference for "remote-end-collapse" is further enhanced by the presence of the flow inducer fitment 7 within the pouch and provided with the characteristics of:

(i) Presenting continuous flow passages from the tips 27, 29 at the upper ends of the two limbs of the fitment 7 all the way to the bore through the threaded portion 9 at the outlet end of the discharge fitting 3.

(ii) Regularly occurring inlets to these continuous flow passages, defined by notches 31 in outer walls, to allow ink from all locations along each limb, and on both sides of each limb, to enter the continuous flow passages, and (iii) The provision of projecting central walls between the notched outermost walls, to hold the plastic film of the pouch in a substantially straight configuration across the notched edge of the outer walls.

Figure 2:
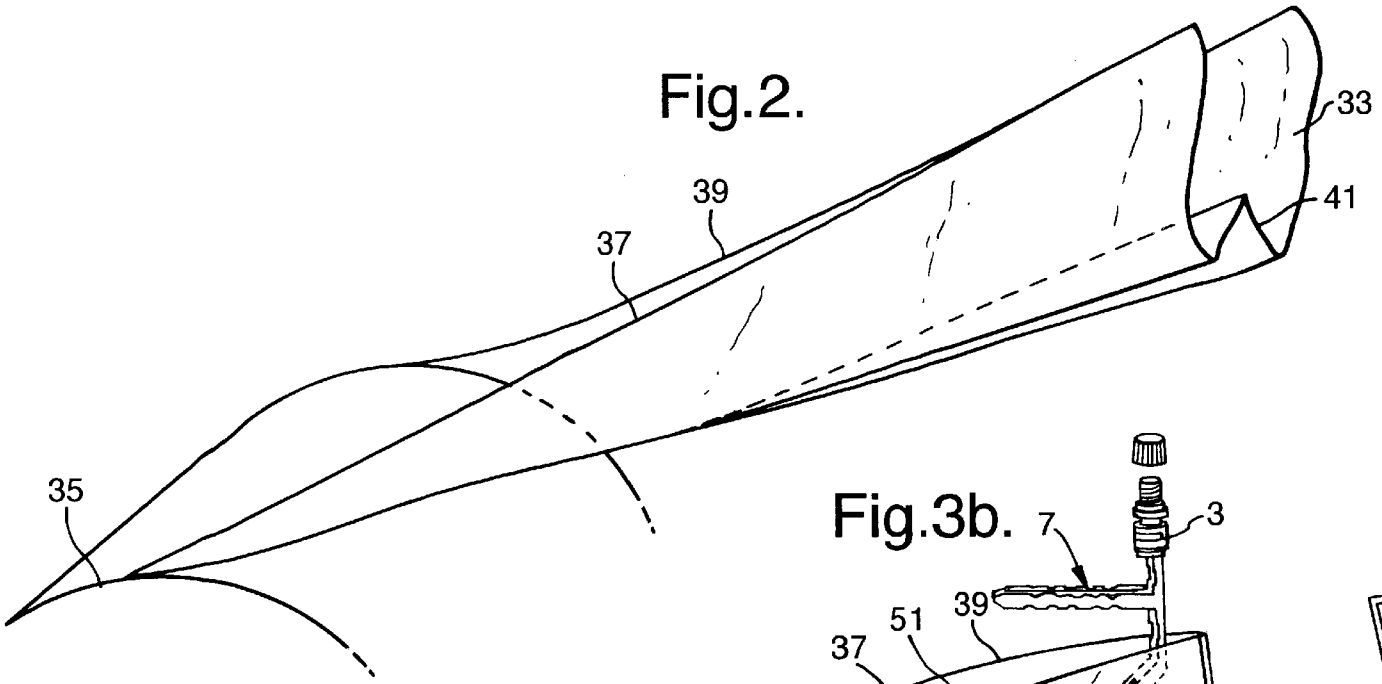
FIG. 2 is a view showing continuous thermoplastic film stock being withdrawn from a roll to form a plurality of the pouches of the type shown in FIG. 1.

The method of constructing the pouch 1 shown in FIG. 1 is illustrated with reference to FIGS. 2 and 3 as follows:

In a first step a continuous film web 33 is withdrawn from a supply roll 35 and, during its movement away from the supply roll, it has its marginal portions 37 and 39 brought towards one another and its central region folded inwardly, as at 41 in FIG. 2, to provide what will eventually be a gusset in the finished pouch. In the orientation of the pouch as shown in FIG. 1, the gusset 41 will extend from top to bottom of the right hand end of the pouch (concealed from view in FIG. 1). It will of course be appreciated that the configuration shown in FIG. 2 can be achieved in other ways, for example by taking a centre-folded film on a supply roll 35 and then rearranging its fold edge to fold inwardly to form the gusset, while the marginal edges remain in register.

Figure 3B:
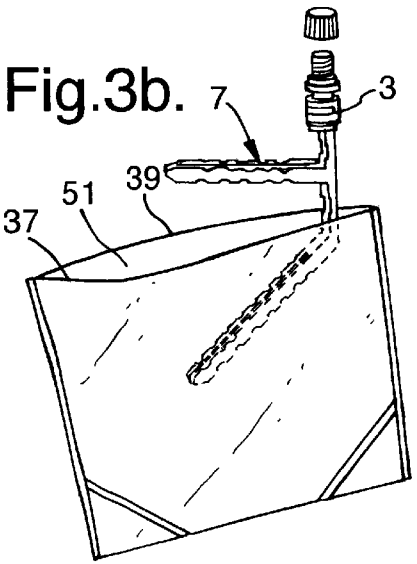
FIGS. 3*a* to 3*g* show a process of manufacturing individual pouches, fitted with liquid exhaust fitments, and placed within enclosing "secondary packaging" boxes.
Figure 3C:
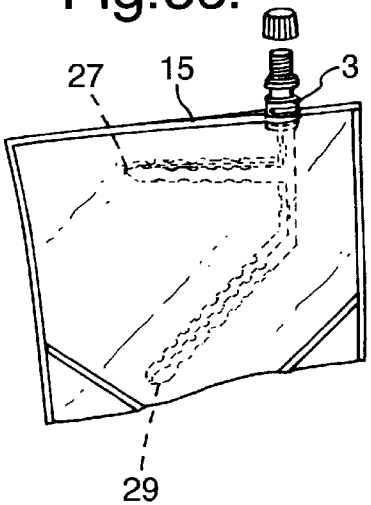
Figure 3A:
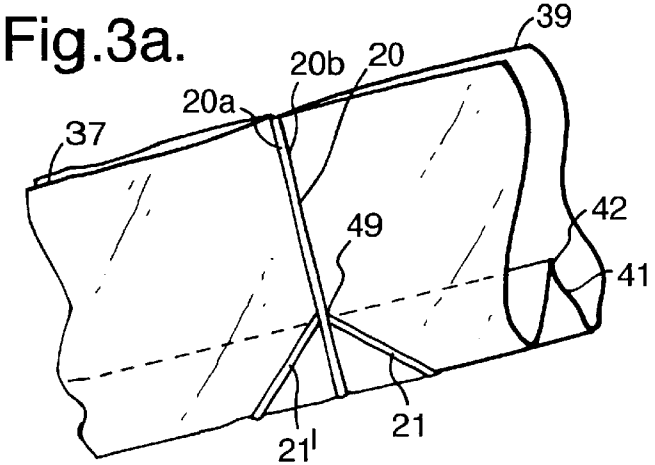

In FIG. 3*a* the individual pouches become severed from one another by means of a composite heat seal line 20 comprising two closely spaced parallel heat seals 20*a*, 20*b* with a cut or perforation line (not shown) between them to provide the required severing of the left hand bag from the right hand bag in FIG. 3*a*. At the end of the composite seal line 20 adjacent the gusset 41 are two shorter seal lines 21 and 21', respectively, which diverge from the composite seal line 20 from a point 49 at the apex 42 of the gusset 41.

In the FIG. 3*a* condition the marginal edges 37 and 39 of the bag are held apart, so as to provide an opening 51 into which the flow inducer fitment 7 with its integral discharge fitting 3 can be introduced in FIG. 3*b* with the discharge fitting 3 able to become sealed to the marginal edges 37 and 39 in FIG. 3*c*. This may, if desired, be effected during formation of a longitudinal closing seal line 15 (see also FIG. 1).

Figure 3D:
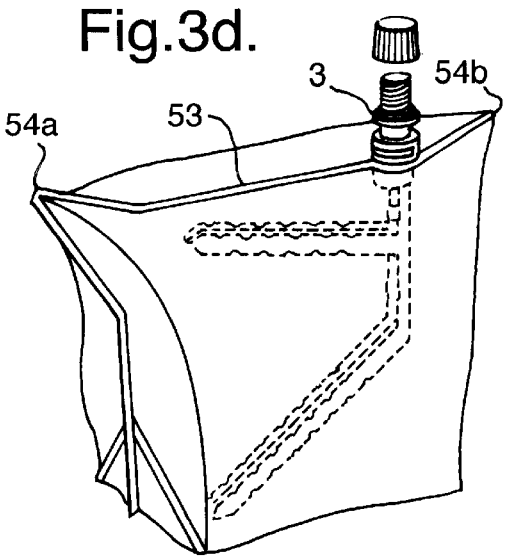

In FIG. 3*d* the pouch of FIG. 3*c* has been partially inflated so that the left hand and right hand ends 54*a* and 54*b* of the just formed longitudinal seal line 15 remain spaced from one another while the lower portion of the pouch, remote from the discharge fitting 3, spreads itself apart at the gusset region in order to cause the pouch to adopt a configuration with a substantially rectangular base as compared with the much narrower configuration at the top of the pouch along the seal line 15.

Figure 3E:
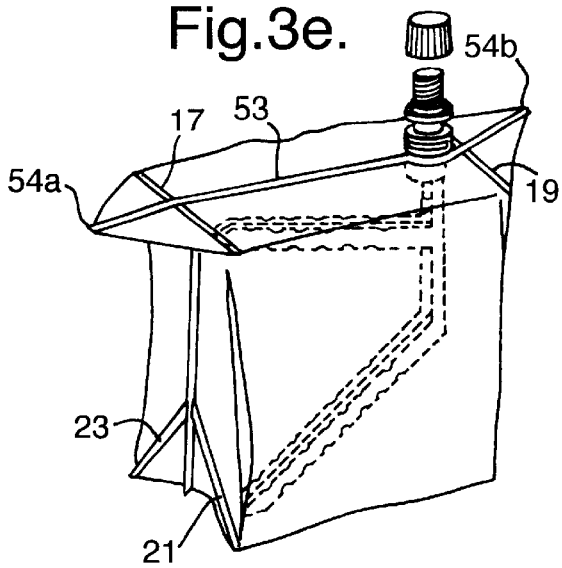

As shown in FIG. 3*e*, the triangular tabs which include the ends 54*a* and 54*b* of the seal line 15 are grasped and flattened and a pair of transverse seal lines 17 and 19 is formed so as to leave empty the double-walled triangular tabs defined between these transverse seal lines 17 and 19 (see also FIG. 1) and the respective ends 54*a* and 54*b* of the seal line 15.

It will be appreciated that the seal lines 15,17,19 and 20*a* are also visible in FIG. 1 as well as in certain of FIGS. 3*a* to 3*f*.

Figure 3F:
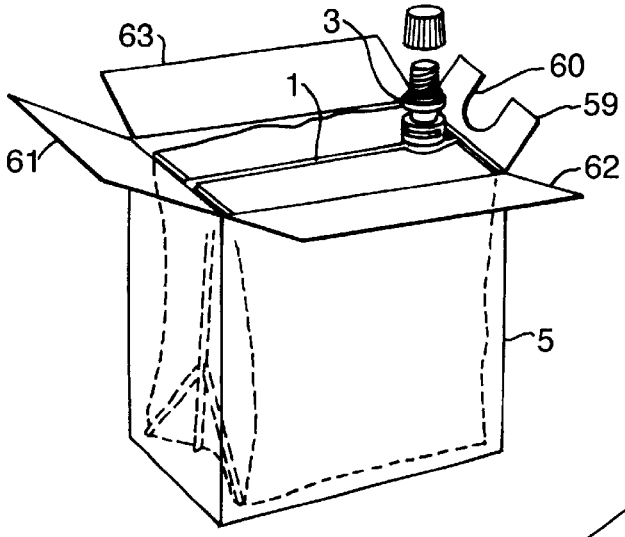

From FIG. 3*e* it is necessary to prepare the pouch for insertion in the carton 5 at FIG. 3*f* and to do so requires the two triangular tabs to be folded downwardly about the respective seal lines 17 and 19 so that these tabs can then enter the box as shown in FIG. 3*f*.

Finally, again with the pouch 1 in a deflated configuration, the pouch is inserted into the carton and the side tabs 62 and 63 are then folded over to intersect one another. Finally, to complete closing of the carton. the cut away end tab 59 and the plain opposite end tab 61 are then folded down on to the top of the pouch in such a manner that the discharge fitment 3 fits neatly in the cut out 60 of the tab 59.

Figure 3G:
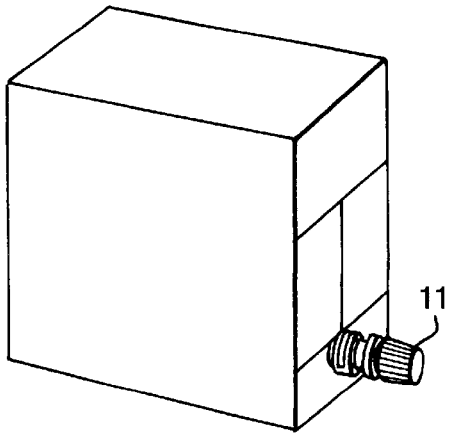

Although not shown in FIG. 3*f*, the two side tabs 62 and 63 may include semi-circular notches to fit about the cylindrical discharge fitting 3 or alternatively, particularly if there is no flow inducer fitment 7 attached to the discharge fitting 3 the discharge fitting 3 may be pressed down into the box in the manner of a wine box discharge tap and then the two plain tabs 62 and 63 can be closed together to provide a neat finished rectangular parallelepiped-shaped box without the protruding fitment, thereby facilitating storage. However, whereas the version having the protruding discharge fitting 3, shown in FIG. 3*g*, is then passed to a filling station at which the blanking plug 11 is removed and the evacuated pouch is filled with ink, in the alternative form with a "pushed-in" discharge fitment 3 the filling operation will need to be carried out before the folding over of the side tabs 62 and 63.

Figure 4A:
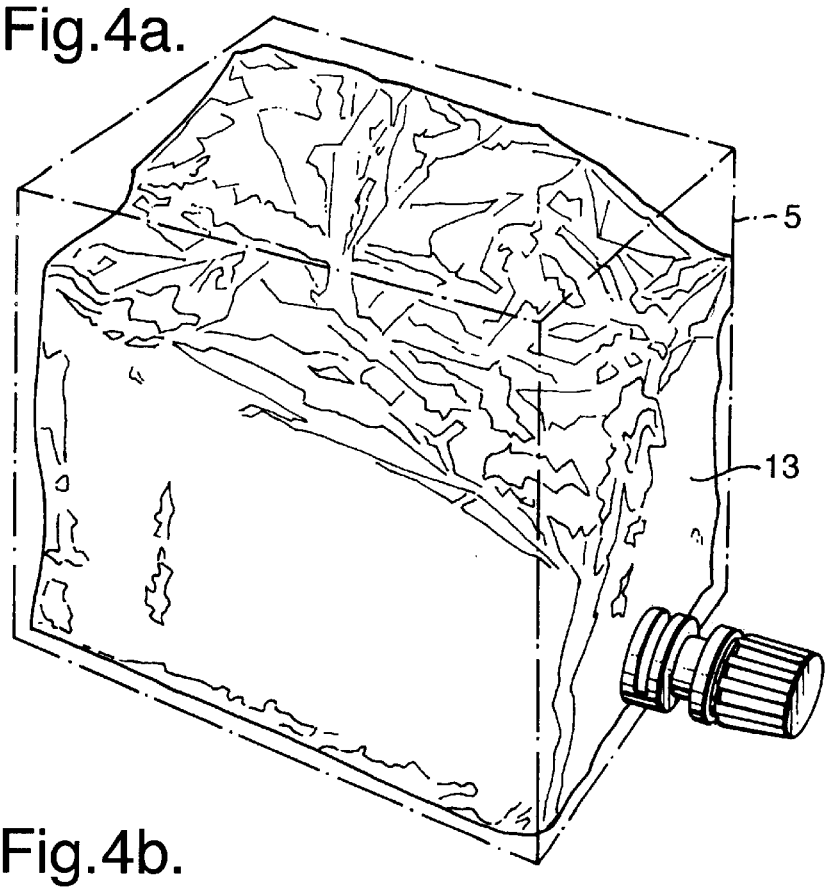
FIGS. 4*a* to 4*f* show the progressive collapsing of the pouch within the secondary packaging box during extraction of ink in use of the pack.

FIGS. 4*a* to 4*f* show the collapsing mode of the pouch which results in the panel 13 remaining substantially flat against the right hand wall of the carton 5 whereas the gusset region at the opposite end of the pouch has begun to fold inwardly. For this purpose the limb 84 (FIG. 1) of the flow inducer fitment 7 which terminates at tip 29 near the top left hand end of the pouch as shown in FIG. 4*a* is inclined to the vertical so as to allow the central region of the gusset to collapse inwardly towards the end of the package where the discharge fitting 3 is located.

Figure 4B:
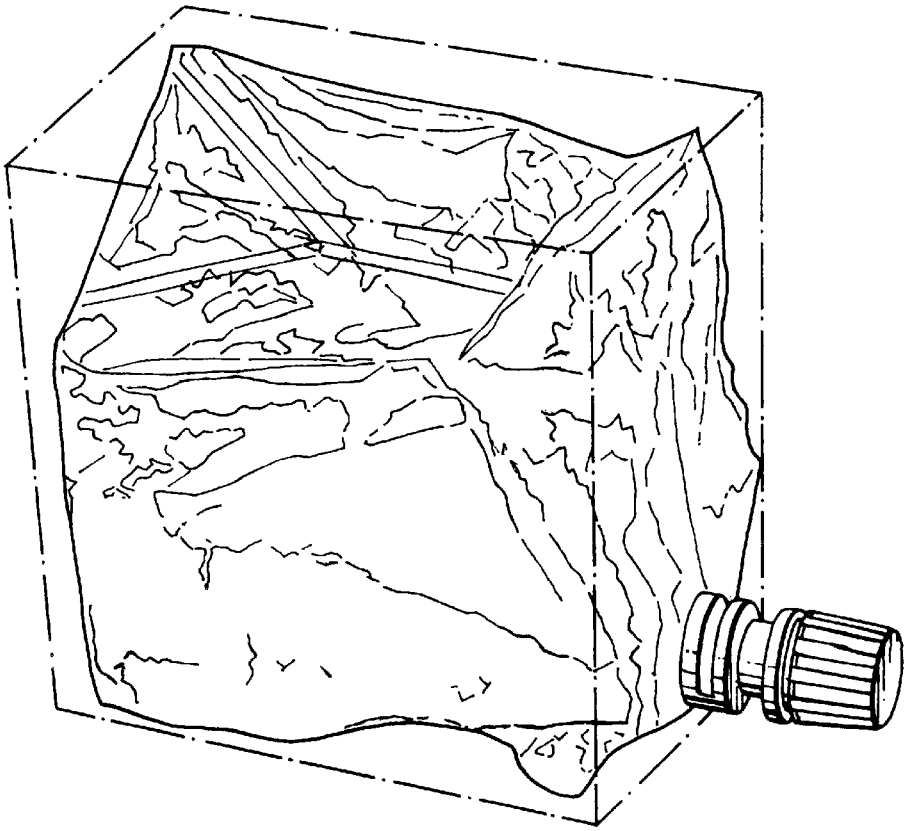

FIG. 4*b* shows that the presence of the flow inducer fitment 7 restrains descent of the front and rear ends of the top panel of the pouch and thus allows the central region of the pouch to move downwardly to allow unimpeded discharge of the contents of the pouch from near the centre of the volume within the pouch.

Figure 4C:
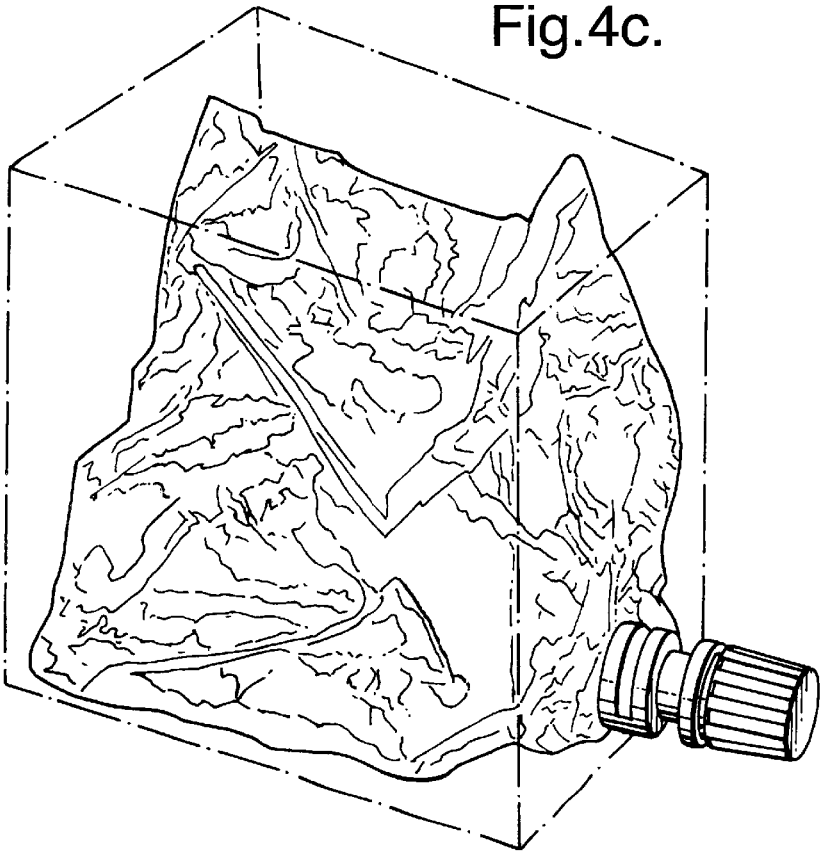

FIG. 4*c* shows this descent of the top panel as having proceeded still further, and also illustrates that the side panels (the one nearest the observer in FIG. 4*c* and the opposite one furthest from the observer) have now begun to collapse in their central regions.

Figure 4D:
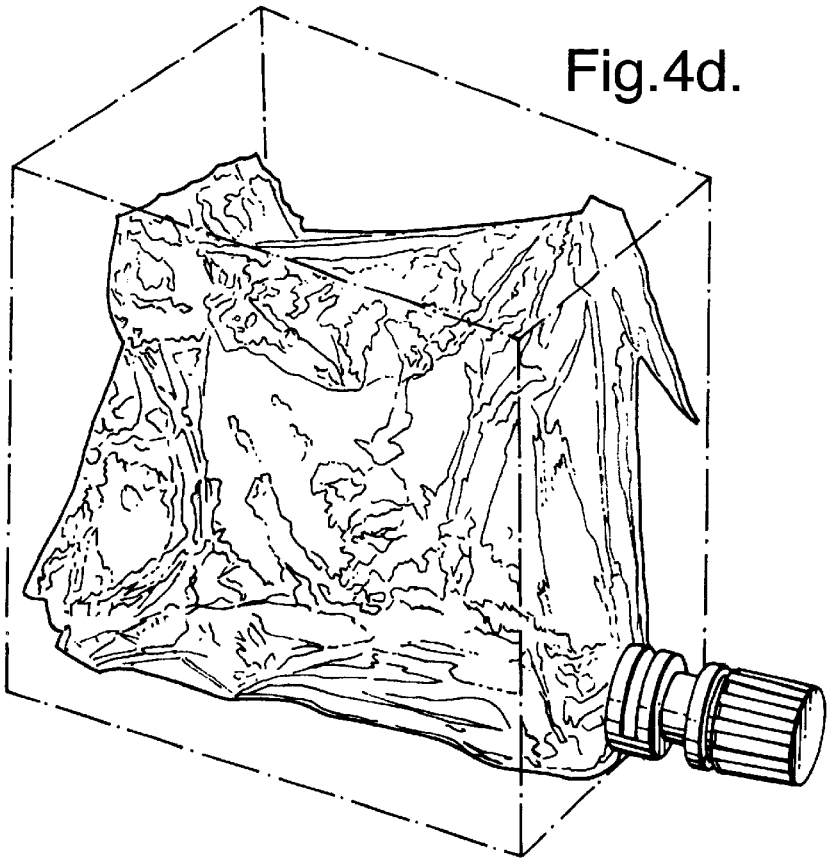

FIG. 4*d* shows still further the bracing action of the two limbs of the flow inducer fitment 7, and the continued collapse of a gusset end of the pouch at the left hand side of FIG. 4*d*.

Figure 4E:
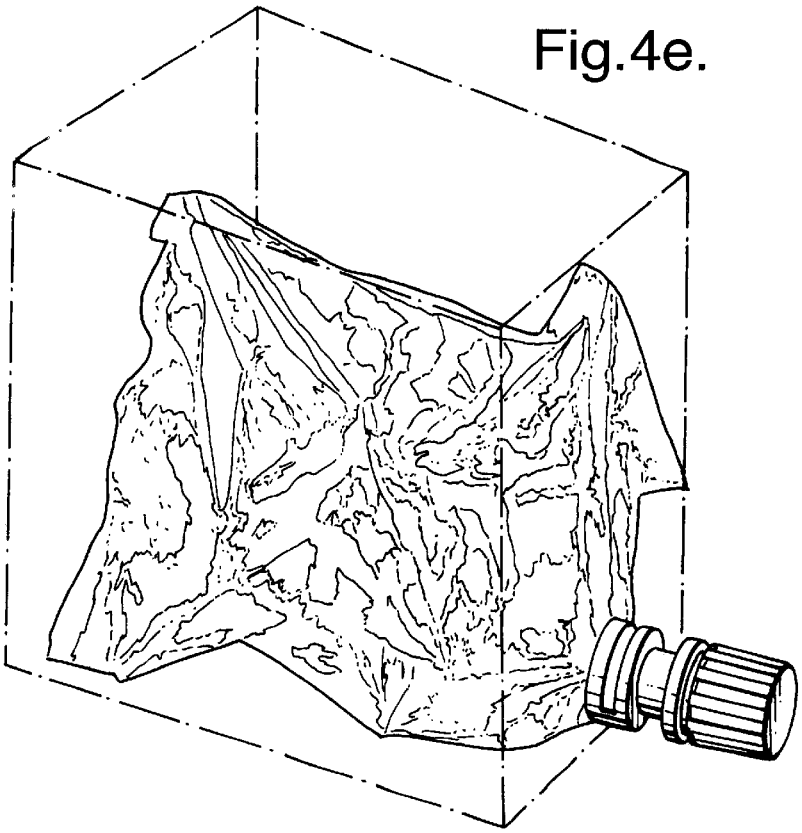
Figure 4F:
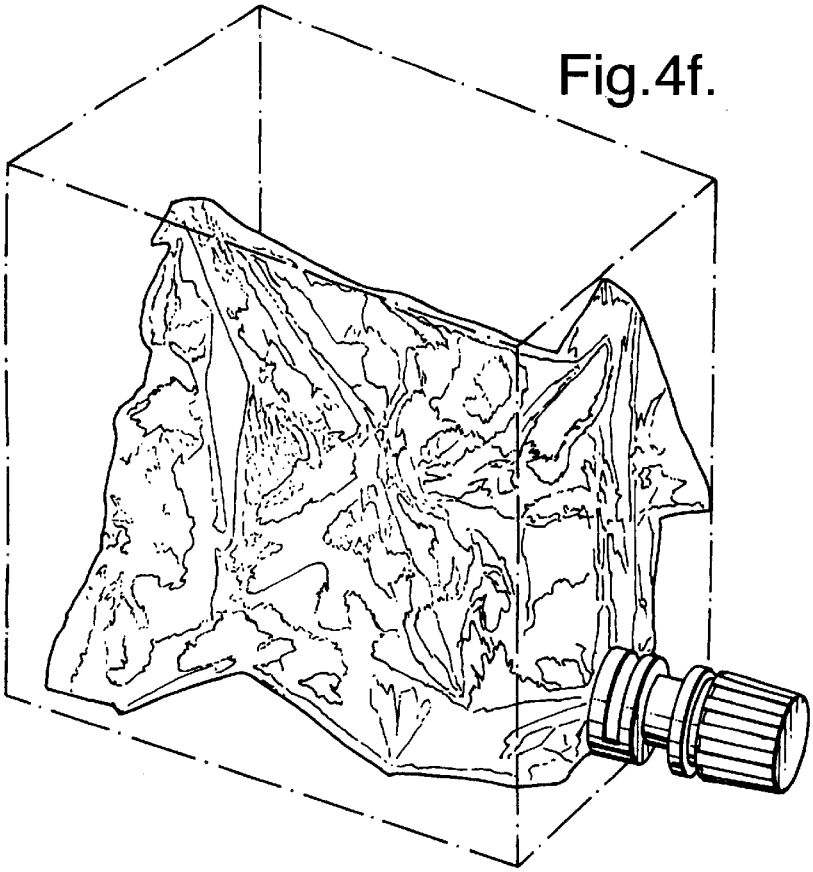

FIG. 4*e*, and then FIG. 4*f*, illustrate still further the general reduction in volume of the interior of the pouch without any substantial change in shape. This is achieved by virtue of the spreading action of the tips of the limbs of the flow inducer fitment, and also by virtue of the regular access of ink to the passages within the flow inducer fitment as will now be described with reference to FIGS. 5 to 8.

Figure 5:
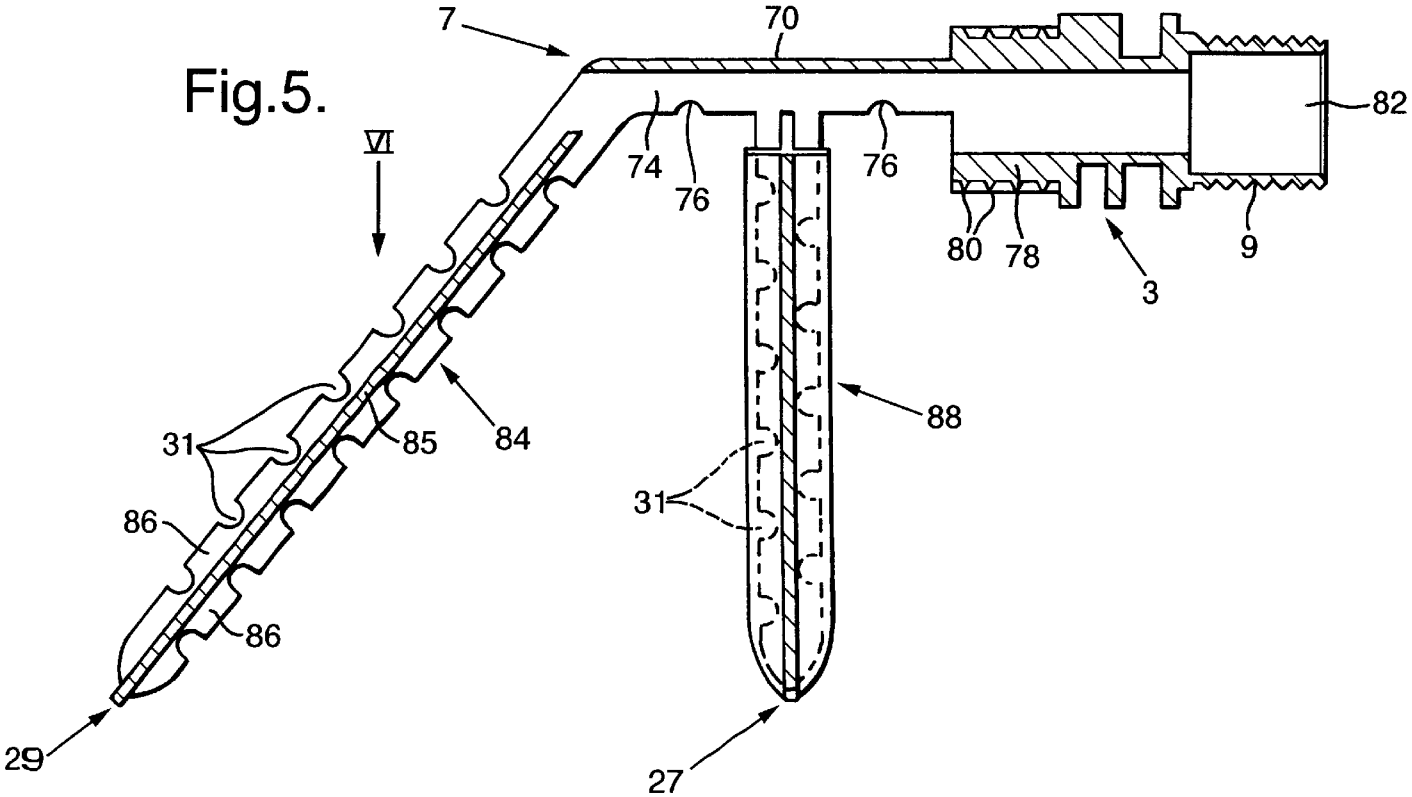
FIG. 5 shows a side elevational view of a flow-inducing fitment which defines, within the pouch, predetermined ink paths remaining open during collapsing of the pouch (taken on the line V—V of FIG. 6)

FIG. 5 shows that the discharge fitting 3 and the flow inducer fitment 7 are integrally formed with one another. However, they could alternatively be formed as two separate components which are subsequently joined together.

The discharge fitting 3 is prolonged as a channel member 70 having two side walls 72 and 74, respectively, each formed with a pair of notches 76.

The cylindrical exterior of an inner portion 78 of the discharge fitting 3 is provided with a plurality of beads 80 which serve to facilitate the sealing of the marginal regions 37, 39 (FIG. 3) around the discharge fitting 3 (in the step illustrated in FIG. 3*c*). At the right hand end of the discharge fitting 3 there can be seen the threaded outlet end portion 9 which has an inner bore 82 to receive a hollow male fitting (not shown) of a stencil duplicator and to be sealed therewith during use of the pouch and carton combination to discharge ink (the blanking plug 11 having therefore already been removed and being in any case omitted from FIG. 5).

Figure 7:
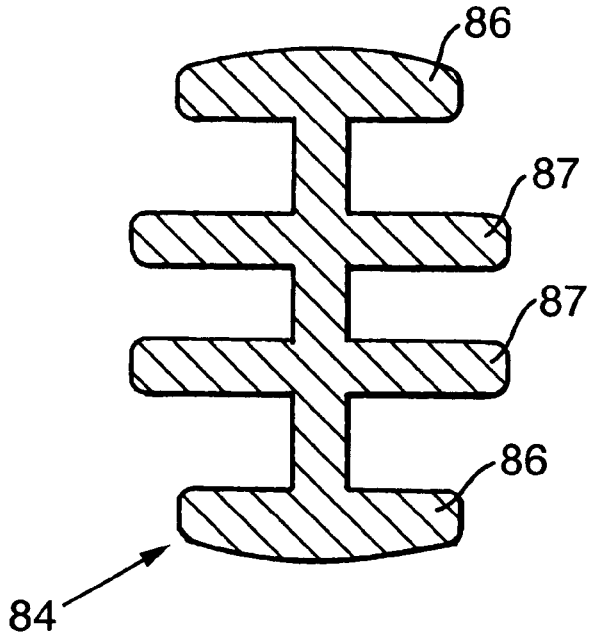
FIG. 7 is a cross-section taken on the line VII—VII of FIG. 6.

The inclined end limb 84 of the flow inducer fitment, terminating at the tip 29, comprises a central web portion 85 having notched or castellated marginal upstanding flanges 86 defining outer walls to either side thereof and unnotched central walls 87 which stand higher than the outer walls 86 as shown in the cross-sectional view of FIG. 7.

The cross-section and overall shape of the perpendicular leg 88 of the flow inducer fitment are the same as that for the inclined leg 84. The various notches 31 (see also FIG. 1) are also visible in FIG. 5 on the two legs 84 and 88.

Figure 6:
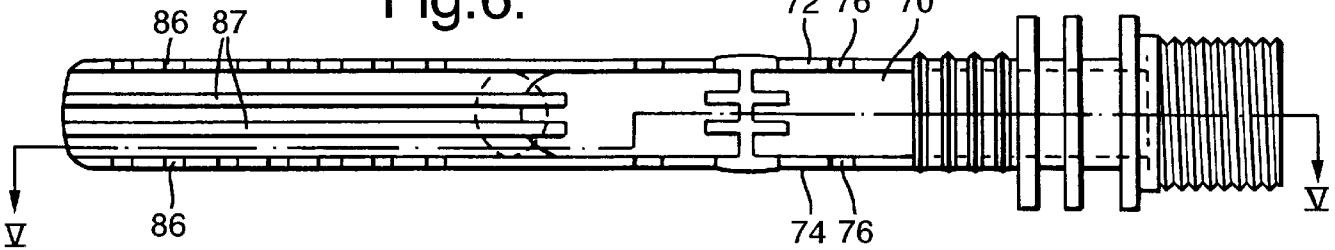
FIG. 6 is a top plan view of the fitment of FIG. 5 as viewed along a direction of arrow VI thereof.
Figure 8:
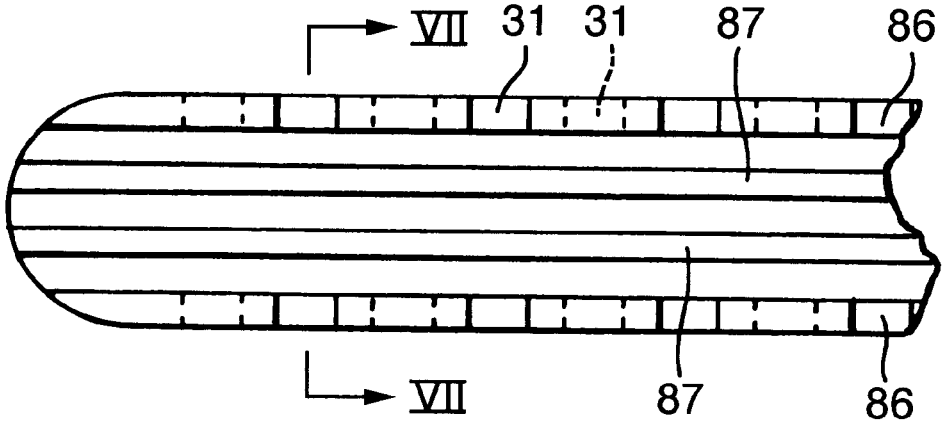
FIG. 8 is an enlarged view of a detail of the left hand end of the flow-inducing fitment of FIG. 6.

Another significant feature of the flow inducer fitment 7 is that the tips 27 and 29 of the two legs 88 and 84, respectively, are tapered so as to provide the maximum possible conformity within the shape of the perimeter of the respective flow inducer fitment leg and the contour of the plastic film web positioned therearound. This taper is in two directions in that, as shown in FIGS. 6 and 8, the central web 85 is rounded at the tip and also, as shown in FIG. 5, the upstanding marginal flanges 86 (and also the central walls 87) are tapered at the tip of the respective arm.

Although the specific examples of the invention, described above, refer to ink for a stencil duplicator it will be understood that the quality of the contents of the container which is important to the invention is its viscosity. Thus it will be appreciated that the container of the invention can be used with any viscous product, especially one having a parallel plate plastomer measurement of from 1.4 cm to 3.5 cm.

Although the present invention is concerned with dispensing of highly viscous liquids, the parallel plate plastometer (PPP) measurement is not strictly a measurement of viscosity but is a measurement of yield value. A yield value is indicated in dynes/cm$^2$ and can be converted into Pascals for the purposes of adopting S1 units. Thus the range of "1.4 cm to 3.5 cm" referred to above equates to a range of from 25 to 392 Pascals.

The PPP test requires a pair of pre-calibrated frosted plates to be cleaned (with methyl ethyl ketone) and dried.

Initially 5 to 10 ml of ink from the pouch whose contents are being tested are discarded. Then a 1 ml syringe is filled from the mouth of the ink tube while applying pressure on the ink tube in order to avoid inducting an air bubble into the syringe. The inducted ink is discarded and this filling process is repeated two or three times to ensure that on the final filling the syringe is uncontaminated.

0.1 ml of ink sample from this final fill of the syringe is deposited on to the centre of the bottom plate (placed with its frosted side uppermost).

The top plate, frosted side down, is then placed carefully on top of the ink sample on that bottom plate.

The plates are left untouched for a 15 minute interval which is measured precisely, using a stop clock. Precisely at the end of the 15 minute delay the ink blob in between the plates is measured by holding a piece of metric graph paper over the top plate, but without applying any downward pressure on to the top plate.

The degree of spread of the ink blob is measured in terms of the mean diameter of the blob and the PPP yield value in dynes/cm$^2$ can be read from the PPP/yield value table shown as FIG. 9.

The value in Pascals will be 1/10th of the YV value given on FIG. 9.

What is claimed is:

1. A container for a liquid to be dispensed, comprising a flexible pouch having a discharge fitting secured to the pouch to communicate between the interior and the exterior of the pouch; and a flow-inducing fitment having spreader arms with tips, said fitment disposed within the pouch to define continuous flow passages for liquid contents of the container from the tips of spreader arms of said flow inducer fitment to said discharge fitting outside the pouch; wherein the pouch is formed of flexible sheet material having a stiffened substantially flat face in which said within the perimeter of said substantially flat face when viewed perpendicularly to the plane of said substantially flat face.

2. A container according to claim 1 wherein the stiffening of said substantially flat face is effected by seals extending along opposite edges of said substantially flat face.

3. A container according to claim 2, wherein said stiffening is reinforced by virtue of tabs extending outboard of said seals and folded into a configuration substantially perpendicular to said substantially flat face.

4. A container according to claim 1, wherein said substantially flat face is at one end of the pouch and wherein the opposite end of the pouch is of gusseted construction to facilitate collapse of said opposite end during extraction of contents from within the pouch.

5. A container according to claim 1, wherein said flexible pouch is disposed within a secondary packaging defining the shape to be occupied by said pouch when the container is full.

6. A container according to claim 1, and including regularly arranged liquid inlets to said continuous flow passages for allowing ingress of liquid from all points along the length of said spreader arms into said continuous liquid flow passages.

7. A container according to claim 6, wherein each said spreader arm includes a central web having spaced lateral flanges extending therefrom, said flanges being notched to provide said regularly arranged points of entry into the continuous liquid flow passage along the central web.

8. A container according to claim 7, and further including at least one inner flange inboard of said notched flanges and having a height greater than that of each said notched flange, said at least one inboard flange having a continuous, non-notched edge standing proud of the notched edges of said lateral flanges.

9. A container according to claim 7, wherein the tips of said spreader arms are tapered.

10. A container according to claim 1, when the pouch contains a liquid having a parallel plate plastometer measurement of from 1.4 to 3.5 cm.

11. A method of forming a container according to claim 1, comprising arranging a film web with marginal portions adjacent one another to define first and second web panels extending from said marginal portions towards a central folded zone, and arranging said folded central film region to have a portion folded inwardly between said first and second film panels;

forming transverse seals across said folded film web to define discrete pouch portions with a gusset remote from said adjacent marginal portions of the film web;

sealing said marginal portions together along a longitudinal seal line with a said discharge fitting between the marginal film portions at said seal to seal the discharge fitting to the pouch; and forming transverse seals intersecting said longitudinal seal line to rigidify the face of the pouch in which said discharge fitment is located.

12. A method according to claim 11, wherein (a) the stiffening of said substantially flat face is effected by seals extending along opposite edges of said substantially flat face, and (b) after sealing along said longitudinal seal line with said discharge fitting therein, and after severing of a plurality of individual pouches from one another by transverse seal-and-separation lines across said folded film web, the individual pouches are inflated to present tabs at each end of said longitudinal seal line, for formation of said transverse seal lines as an edge of each said tab.

13. A method according to claim 12, wherein said pouch is deflated before formation of said transverse seal lines so that said tabs are uninflated.

14. A method according to claim 13, wherein said deflation involves evacuation of the interior of each said pouch.

15. A method according to claim 12 wherein the formation of said transverse seal-and-separation lines includes the formation of inclined seals which intersect said seal-and-separation lines at the location of the apex of said gusset-defining inwardly folded region and which diverge from said seal-and-separation line to intersect the edges of said first and second film panels remote from the longitudinal seal line.

16. A method according to claim 15, and further including the step of folding down said tabs about the transverse seal lines and placing the pouch with its folded-down tabs in a box having the shape of a rectangular parallelepiped substantially conforming to the filled configuration of said pouch.

17. A method of dispensing a viscous product having a parallel plate plastometer measurement of from 1.4 to 3.5 cm, comprising introducing the viscous product into a container according to claim 1, connecting the discharge fitting to the inlet side of a suction pump, and extracting the viscous product from the interior of the pouch, as required, by way of the discharge fitting and the suction pump.

18. A method according to claim 17 wherein the stiffening of said substantially flat face is effected by seals extending along opposite edges of said substantially flat face, and said stiffening is reinforced by virtue of tabs extend outboard of said seals and are folded into a configuration substantially perpendicular to said substantially flat face, said method of dispensing including the step of folding said tabs into the said perpendicular configuration prior to the start of vacuum extraction.

19. An ink package comprising a container according to claim 10 wherein said liquid is ink for a stencil duplicator.

* * * * *

UNITED STATES PATENT AND TRADEMARK OFFICE

CERTIFICATE OF CORRECTION

PATENT NO : 6,105,821

DATED : August 22, 2000

INVENTOR(S) : William C. Christine et al

It is certified that error appears in the above-identified patent and that said Letters Patent is hereby corrected as shown below:

On title page below heading "Inventors" add:
--[73] Assignee: G.R. Advanced Materials LTD
Sterling, Scotland, UK Column 6, line 49, after the word "said" add:
--discharge fitting is secured, and wherein the interior of the pouch falls --

Column 8, line 36, after the word "tabs" add:
--which--.

Signed and Sealed this

Eighth Day of May, 2001

*Attest:*

Nicholas P. Godici

NICHOLAS P. GODICI

*Attesting Officer*

*Acting Director of the United States Patent and Trademark Office*